US005635946A

United States Patent [19]

Francis

[11] Patent Number: 5,635,946

[45] Date of Patent: Jun. 3, 1997

[54] STOWABLE, DEPLOYABLE, RETRACTABLE ANTENNA

[76] Inventor: Aaron Francis, 2277 Anna Dr., Santa Clara, Calif. 95050

[21] Appl. No.: 366,996

[22] Filed: Dec. 29, 1994

[51] Int. Cl.[6] ..... H01Q 15/20

[52] U.S. Cl. ..... 343/915; 343/881; 343/912

[58] Field of Search ..... 343/915, 912, 343/880, 881, DIG. 2, 878, 882, 883, 897; H01Q 15/20

[56] References Cited

U.S. PATENT DOCUMENTS 4,475,111 10/1984 Gittinger et al. ..... 343/915

4,475,323 10/1984 Schwartzberg et al. ..... 343/915

5,307,082 4/1994 Silverberg ..... 343/915

*Primary Examiner*—Hoanganh T. Le

*Attorney, Agent, or Firm*—The Kline Law Firm

[57] ABSTRACT

A portable antenna with a collapsible reflector dish made from a flexible mesh so that the reflector can be folded in upon itself from the deployed position. When closed, the antenna is contained within an outer casing. The outer casing has a top side that opens when the antenna is deployed. Depending upon the specific application, the top side of the outer casing may be flat or conical. The antenna can be deployed by remote element. The driving element extends the support frame for the reflector dish to its deployed position, and raises the boom into its operating position.

9 Claims, 10 Drawing Sheets

INCREASED DIAMETER = A+B

STOWABLE, DEPLOYABLE, RETRACTABLE ANTENNA

FIELD OF THE INVENTION

The present invention relates generally to antennas, and more particularly is a high gain antenna that collapses for storage and transport, and which may be deployed and retracted by remote means.

BACKGROUND OF THE INVENTION

In view of the fact that the field of communications technology is as widespread as it is today, it is not surprising that there would be a large body of prior art relative to antennas.

The field of the present invention is that of portable antennas, and more particularly portable, collapsible, and deployable antennas. These devices are most useful in applications where space is at a premium, such as in satellites, where using an antenna with a large fixed reflector dish is impractical. To address this situation, many structures for antennas with collapsible reflector dishes have been patented.

The prior art is universally addressed to means of collapsing reflector panels, usually rigid, around a central rigid boom. Examples of the prior art are the "FOLDABLE REFLECTOR" of Higgins, et al., U.S. Pat. No. 5,198,832; "FOLDING DISH REFLECTOR" of Robert Luly, U.S. Pat. No. 4,683,475; "COLLAPSIBLE ANTENNA" of Manfred Westphal, U.S. Pat. No. 4,899,167; "DEPLOYABLE OFFSET DISH STRUCTURE" of Palmer, et al., U.S. Pat. No. 4,862,190; "UNFOLDABLE ANTENNA REFLECTOR" of Herbig, et al., U.S. Pat. No. 4,642,652; and "PORTABLE ANTENNA WITH WEDGE-SHAPED REFLECTIVE PANELS", of Gonzalez, U.S. Pat. No. 4,506,271.

At least one reference describes a collapsible dish without specifying a rigid boom, the "COLLAPSIBLE APPARATUS FOR FORMING A DISH SHAPED SURFACE" of Pappas et al., U.S. Pat. No. 5,255,006. This device does retain the use of rigid elements for the dish itself.

There are some references in the prior art which have recognized the desirability of using flexible panels for the components of the antenna reflector. Examples of this particular advancement are "UNFURLABLE MESH REFLECTOR" of Chang, et al., U.S. Pat. No. 4,989,015; and "FOLDABLE ANTENNA REFLECTOR" of Gilles Labruyere, U.S. Pat. No. 4,352,113.

All these prior art devices have as a limitation the fact that they can collapse only around a central boom or central axis, and thus are not of an optimum configuration to minimize storage space requirements.

OBJECTS, SUMMARY, AND ADVANTAGES OF THE INVENTION

It is an object of the present invention to eliminate these restrictions and to provide a construction of a portable antenna that collapses into a very small effective volume for storage and/or transport.

It is a further object of the present invention to provide an antenna that can be remotely deployed and/or collapsed.

In summary, the present invention is a portable antenna with a collapsible reflector dish. The dish is made from a flexible mesh so that it can be folded in upon itself from the deployed position. When closed, the antenna is contained within an outer casing. The outer casing has an upper surface that opens when the antenna is deployed.

Depending upon the specific application, the outer casing may have a flat upper surface, or if additional width for the reflector dish is desired, the upper surface may be conical.

The antenna can be deployed by remote means. Deployment is accomplished by known mechanical driving means. The driving means extends the support frame for the reflector dish to its deployed position, and raises the boom into its operating position.

An advantage of the present invention is that it allows a large antenna to be stored in a relatively small space.

A further advantage of the present invention is that due to its use of a flexible material for the reflector dish itself, the dish can be folded along multiple axes to reduce the storage space required.

These and other objects and advantages of the present invention will become apparent to those skilled in the art in view of the description of the best presently known mode of carrying out the invention as described herein and as illustrated in the drawings.

BEST MODE OF CARRYING OUT THE INVENTION

Figure 1:
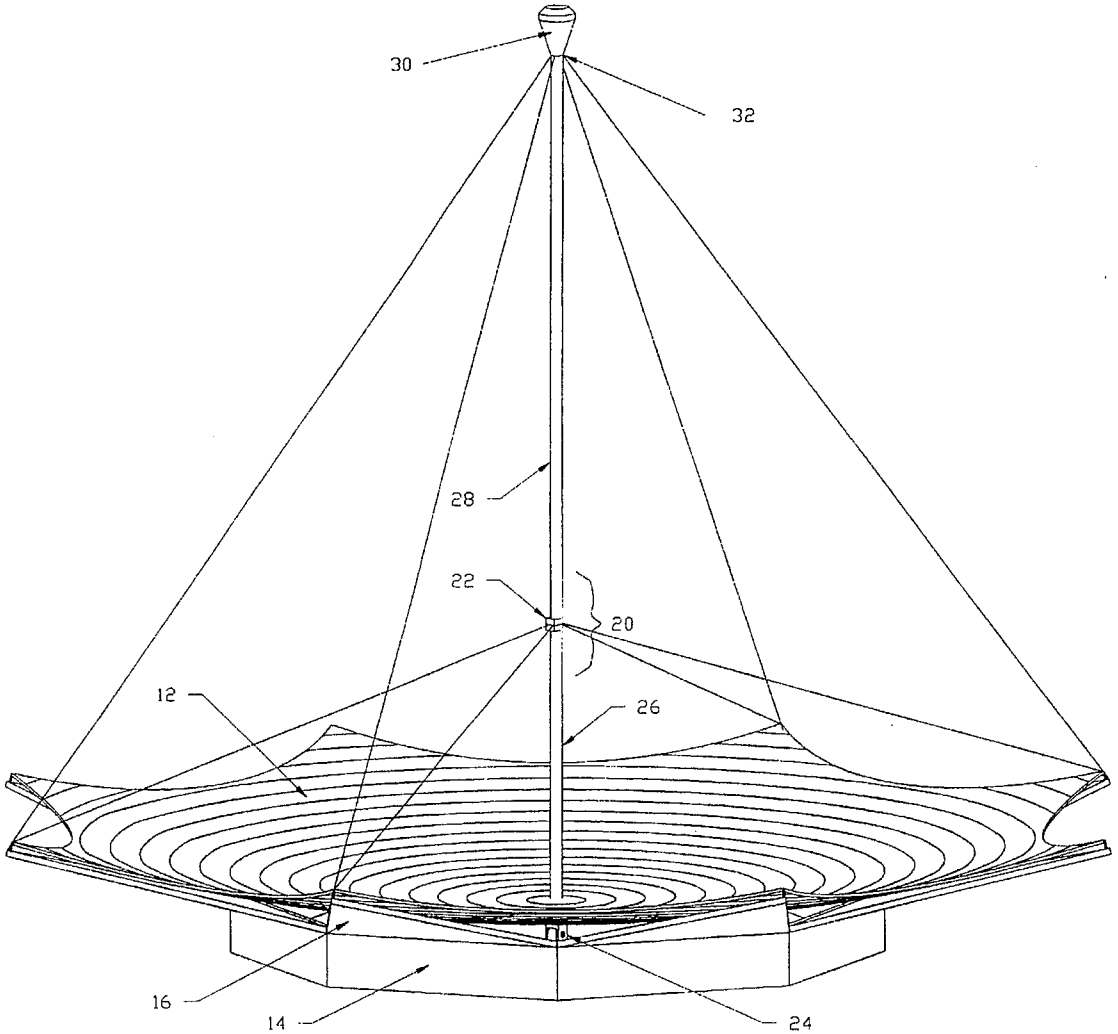
FIG. 1 is a perspective view of the antenna of the present invention in the deployed position.
Figure 2:
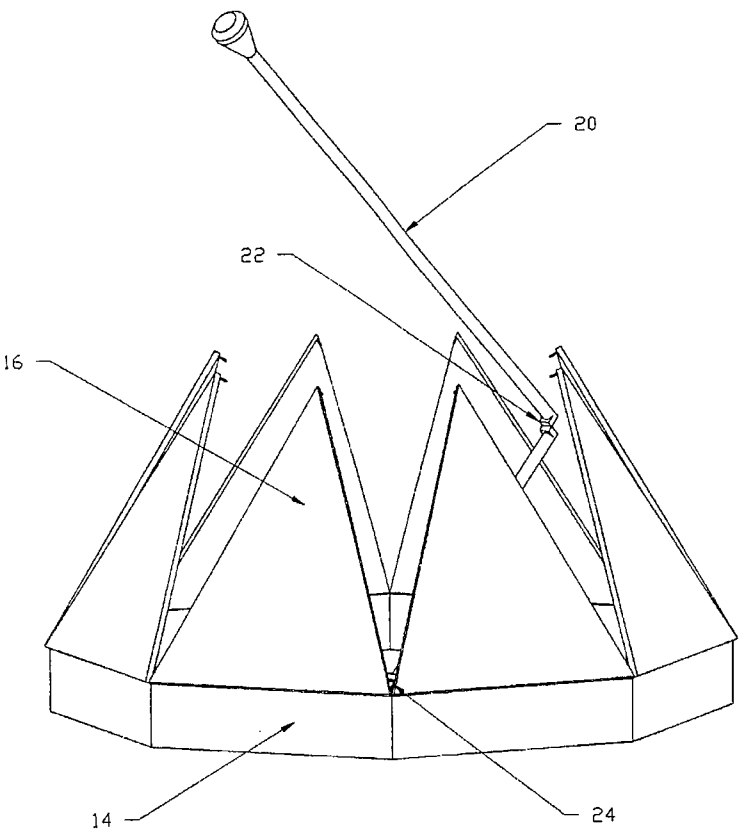
FIG. 2 is/a perspective view of the antenna and its casing in a partially closed position.
Figure 3:
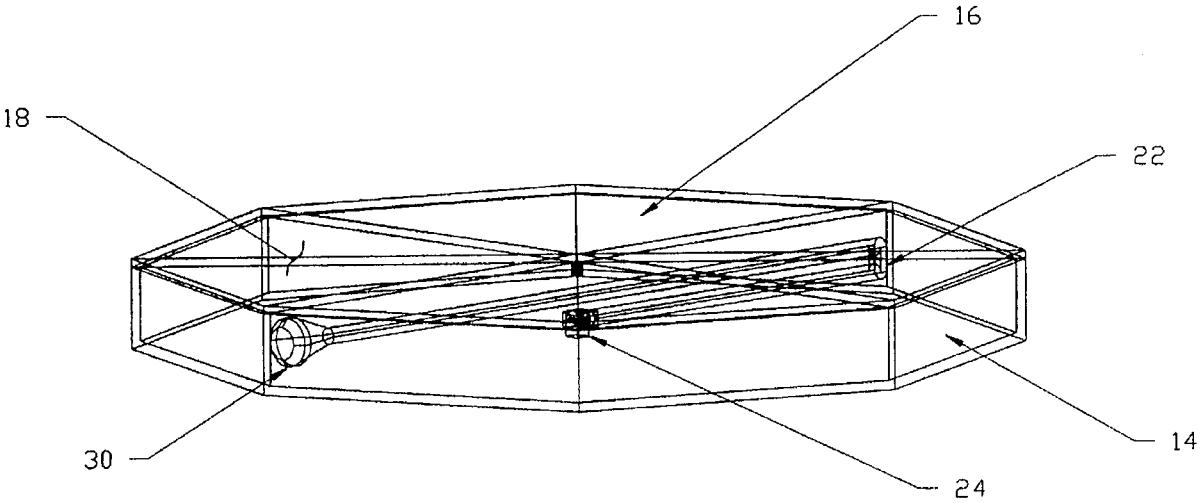
FIG. 3 is a perspective view of the antenna and its casing in the closed position.

The present invention is a portable high gain antenna 10. Referring chiefly to FIGS. 1–3, it can be seen that the antenna 10 includes a flexible reflector dish 12 contained within an outer casing 14. The reflector dish 12 will be formed from a flexible mesh material.

The casing 14 includes multiple panels 16 which form a top side 18 of the casing 14. The panels 16 are triangular in shape, their exact conformation depending upon whether a user desires the antenna to affix to a bus 50 with a flat top side 18 (as shown in FIG. 5), or a conical top side 18 (as shown in FIG. 6).

Figure 8:
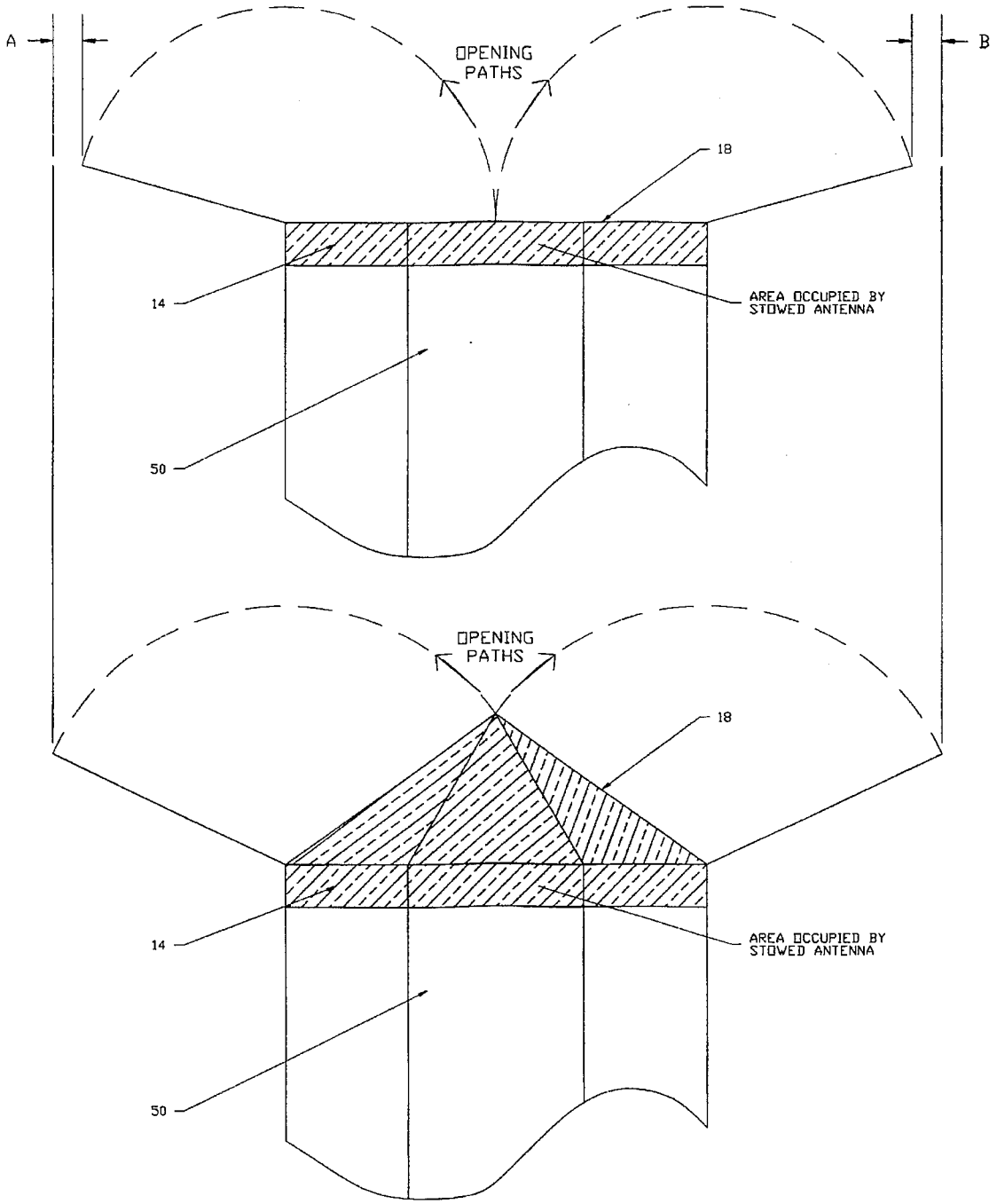
FIG. 8 is a superimposition of the flat and conical embodiments illustrating the difference in obtainable reflector width for a given storage width.

Design considerations for a given application will generally determine whether the flat or conical configuration is chosen. Very often the space available to store the casing and the antenna will dictate the configuration. As illustrated in FIG. 8, additional reflector dish size can be obtained for a conical versus flat configuration for a given horizontal storage space.

Figure 6:
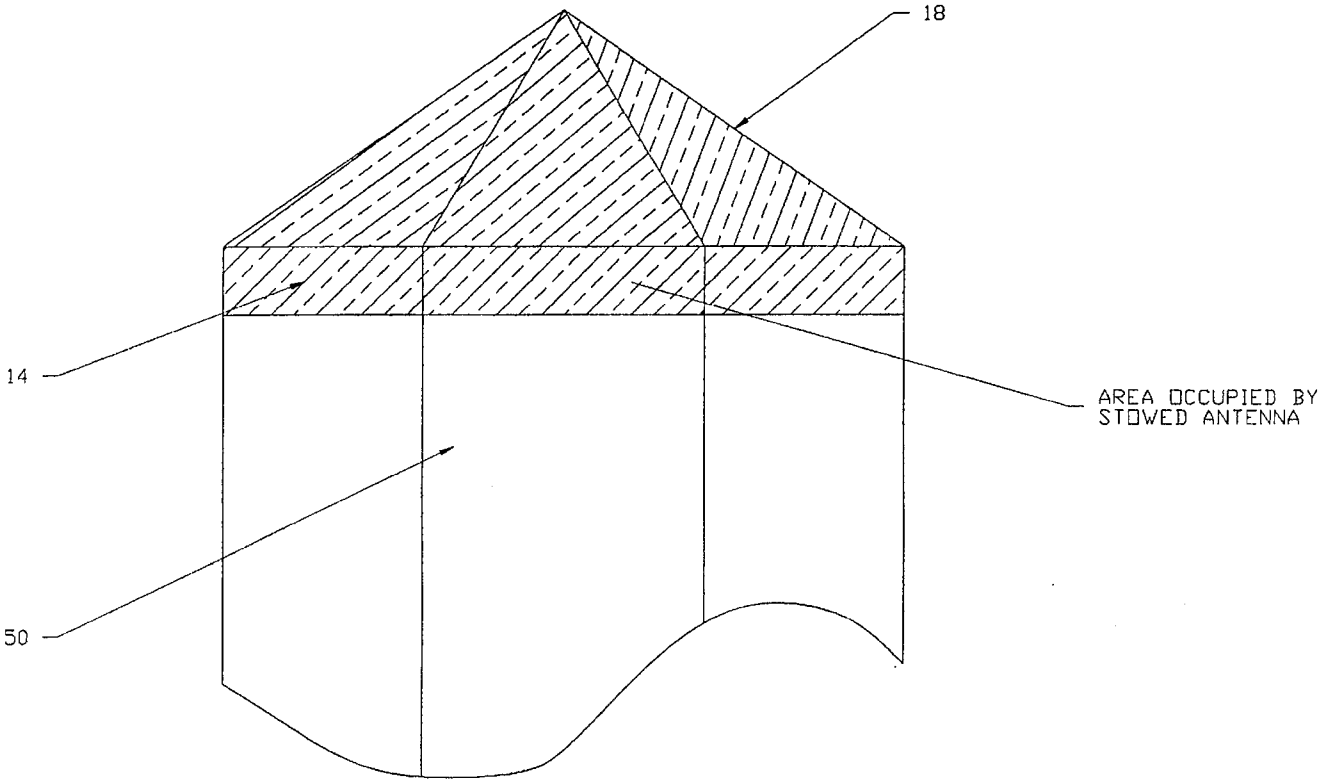
FIG. 6 is a side view of an embodiment of the present invention with a conical upper surface.
Figure 7:
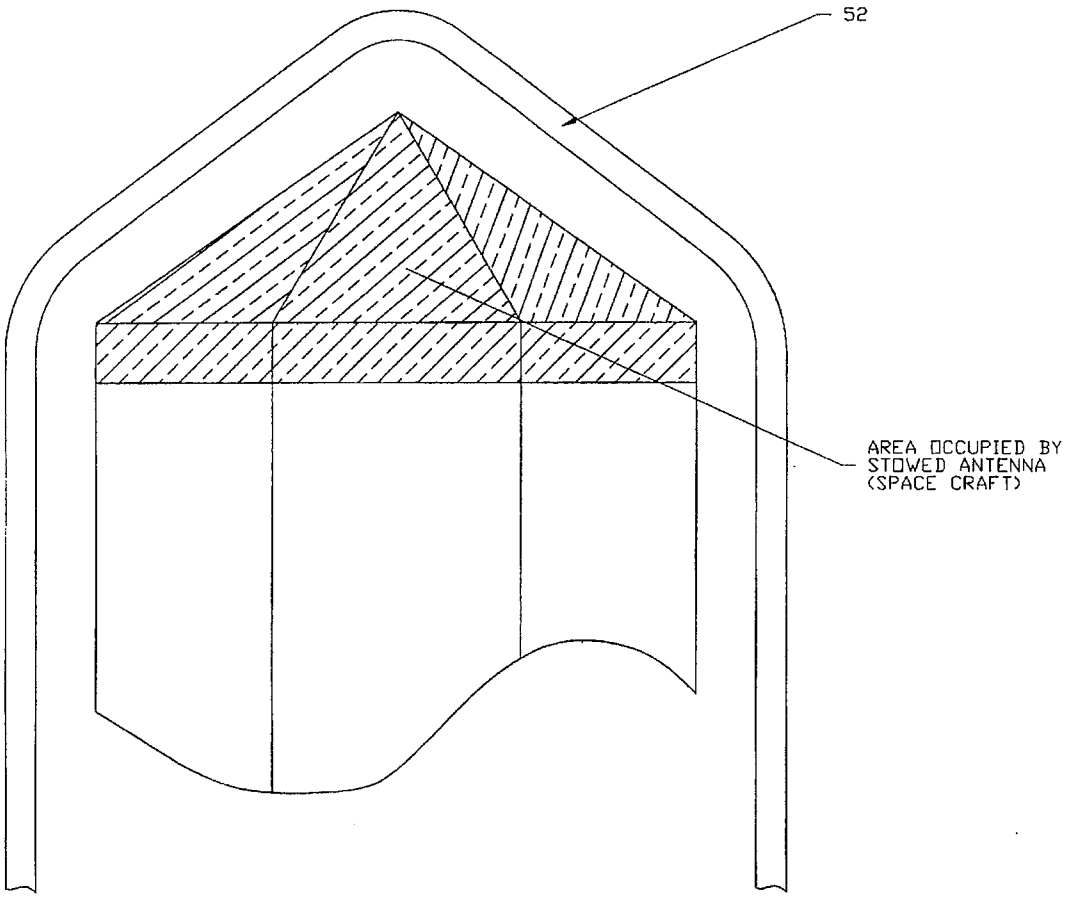
FIG. 7 is a side view of an embodiment of the present invention with a conical upper surface within a launch vehicle.

The advantage gained by the conical conformation illustrated in FIG. 6 is particularly useful in a satellite application. When the satellite is contained in a nose cone 52, the conical configuration allows the antenna to conform to the shape of the nose cone 52, (see FIG. 7), and thereby give the user additional dish surface area for the horizontal cargo space required.

Figure 5:
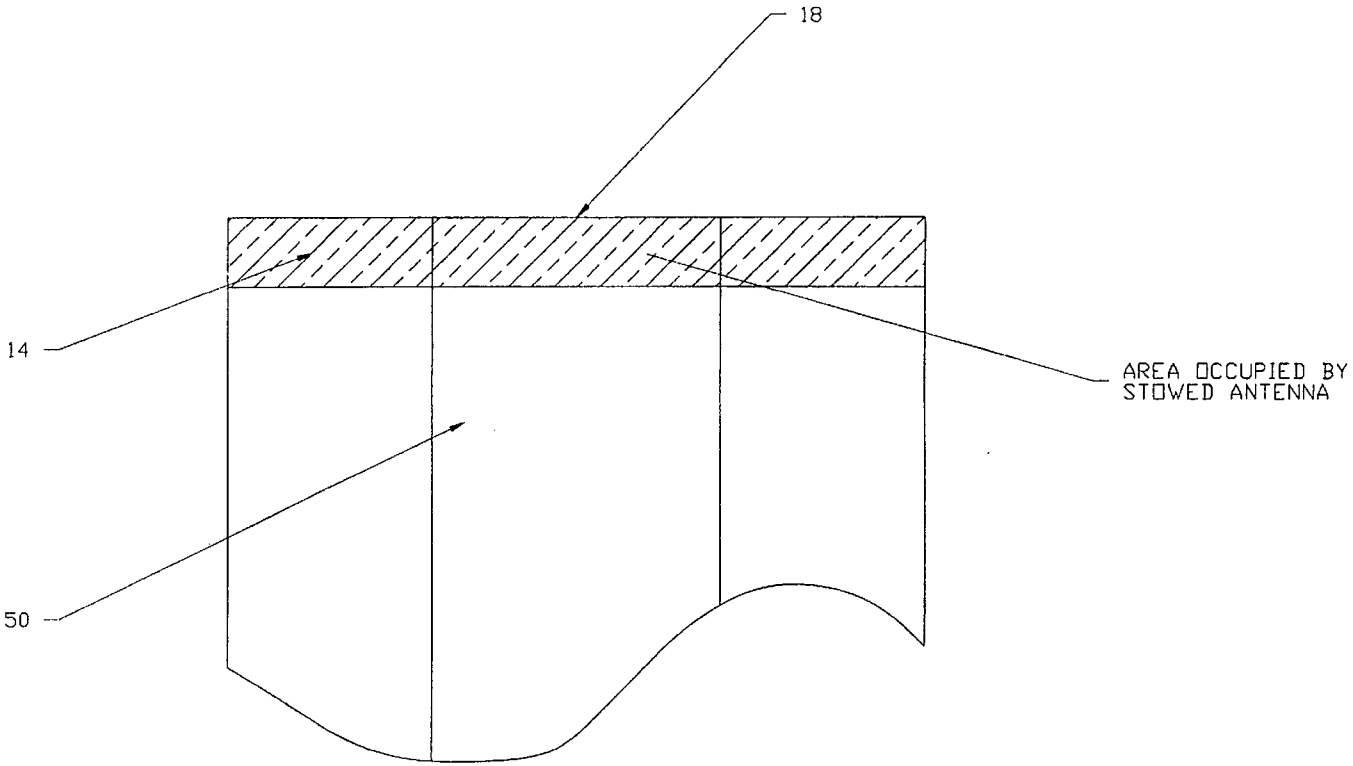
FIG. 5 is a side view of an embodiment of the antenna of the present invention with a flat upper surface.

When vertical clearance is a higher priority consideration for the user, such as when the antenna is installed on a recreational vehicle, the user will likely choose the flat configuration depicted in FIG. 5.

Returning to FIGS. 1–3, it is seen that a Jointed boom 20 is hingedly affixed at the center of the antenna 10. The boom 20 includes at least one Joint 22 at a position above a hinged attachment point 24, the Joint 22 dividing the boom into a lower segment 26 and an upper segment 28. The antenna's receiver 30 is affixed to a free end 32 of the boom 20.

Figure 4:
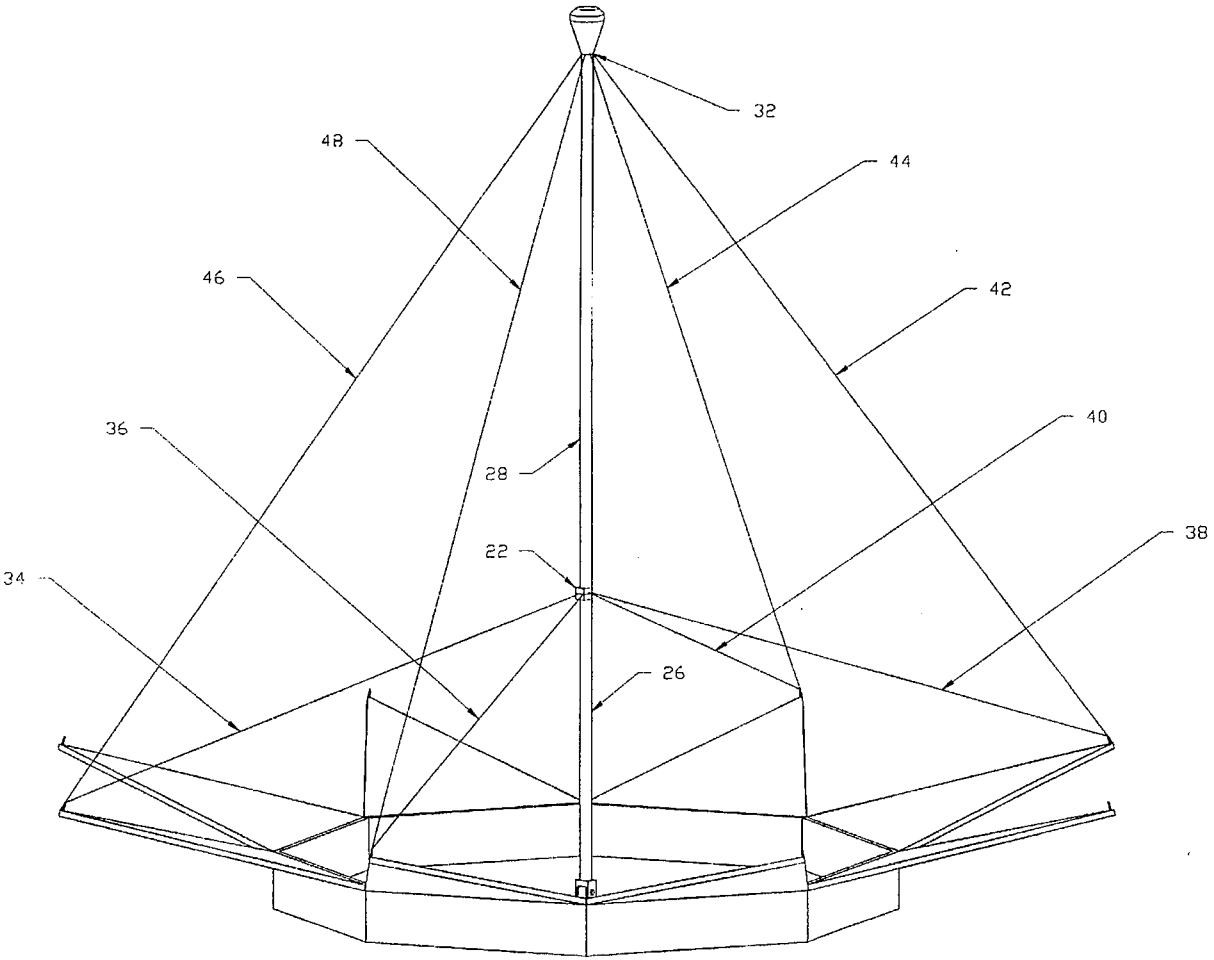
FIG. 4 is a perspective view of the antenna's reflector dish support structure, with the reflector dish itself not shown.

The panels 16 along with multiple guy wires 34–48 form a support structure/deployment mechanism for the reflector 12 and the boom 20. When the antenna is fully deployed, the guy wires 34–48 fix the boom in position, and pivot the panels 16 to their fully open position, thereby fixing the reflector 12 in its fully open position. This supporting structure is illustrated without the reflector panel in FIGS. 2–4.

Stowing of the antenna 10 follows the progression shown in FIGS. 1–3. From the fully deployed position shown in FIG. 1, the support structure is collapsed in order to stow the antenna. The boom 20 folds at the Joint 22 as well as at the attachment point 24. This allows a boom 20 whose deployed length is much greater than the width of the casing 14 to be stowed within the confines of the casing 14.

As the boom 20 is collapsed and lowered into the casing 14, the guy wires 34–48 pull the panels 16 of the casing 14 inward. Inasmuch as the reflector dish 12 is attached to the panels 16 of the casing 14, as the panels 16 are pulled inward, the reflector dish 12 is folded into the interior of the casing 14 as shown in FIG. 3.

Because the reflector dish 12 is formed from a flexible mesh material, the reflector dish 12 folds along radial as well as circumferential axes, thereby minimizing storage space.

Deployment of the antenna 10 simply requires essentially a reversal of the process described above. The panels 16 of the casing 14 are opened by the deployment means, which in turn pulls the reflector dish 12 into its deployed position. As the casing 14 opens, the guy wires 34–48 to pull the boom to its fully extended position illustrated in FIG. 1. The arrangement of the guy wires in opposing pairs holds the boom in its proper position and eliminates hyperextension of the boom segments.

Because many such methods are well known in the art, driving means for the extension and retraction of the boom, and hence the antenna, are not discussed in detail here. It is envisioned that typically an electric motor in combination with shaft and gear mechanisms would be used to drive the deployment means. A cable and pulley system powered by an electric motor could also be used.

Figure 9:
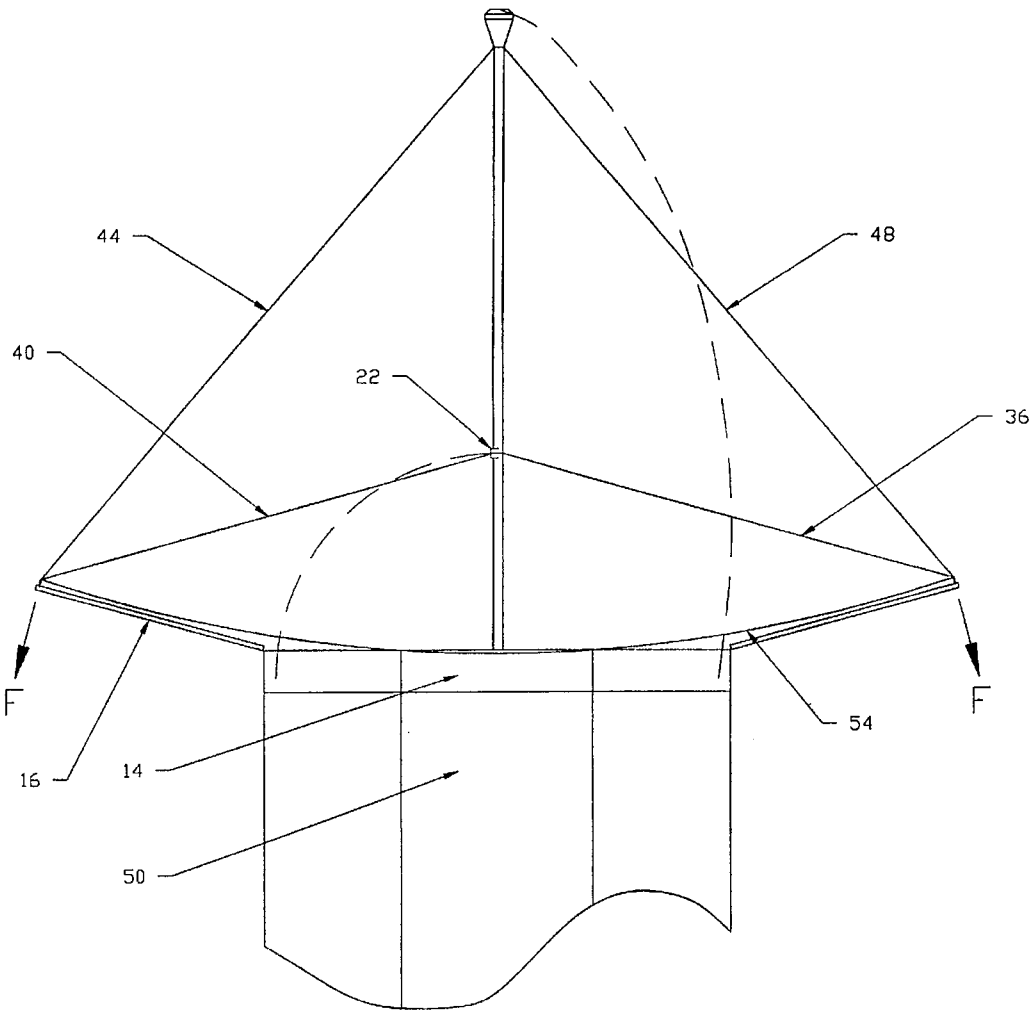
FIG. 9 is a side view of the antenna in the deployed position assembled with longer on deployment means.
Figure 10:
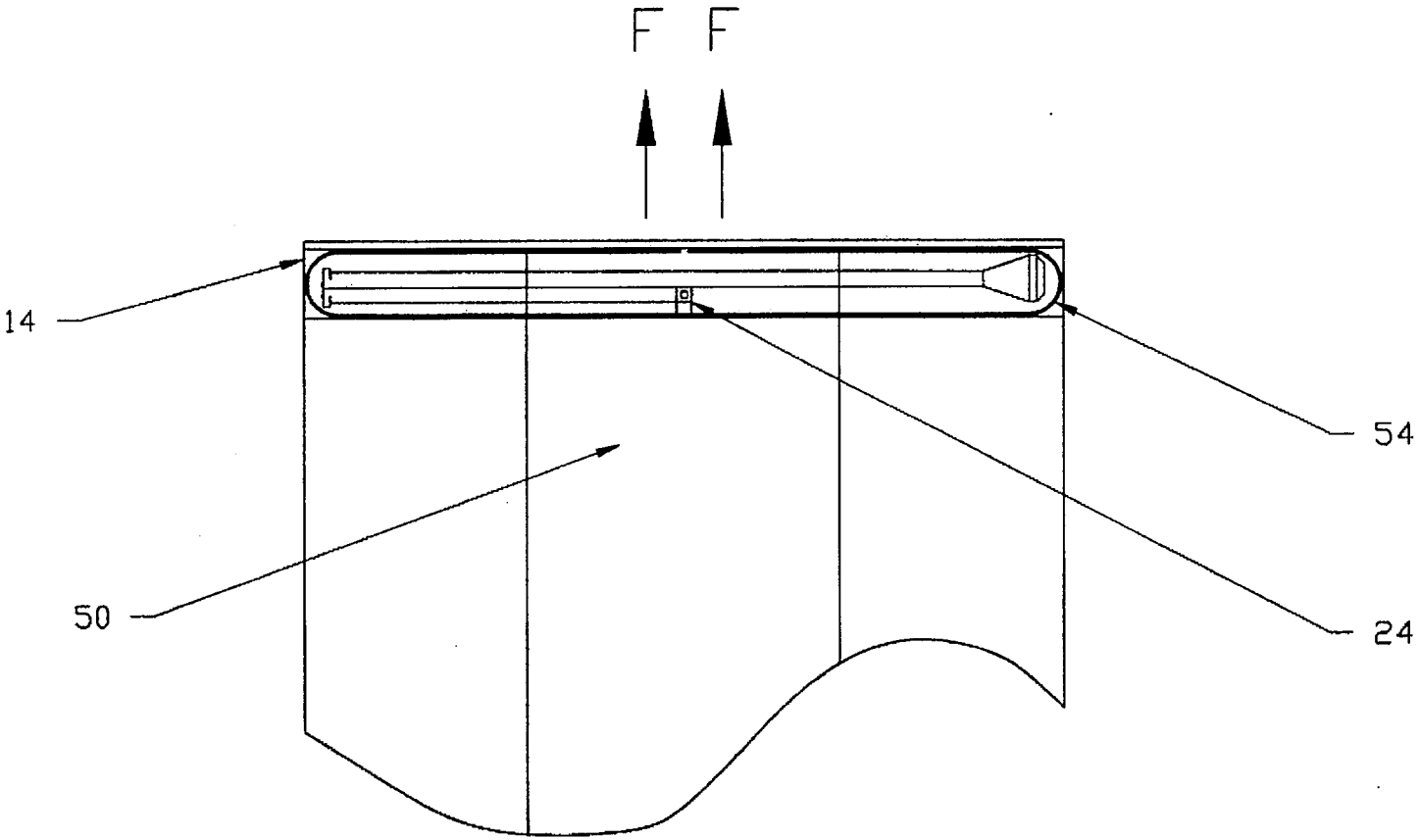
FIG. 10 is a side view of the antenna in the stowed position with longer on deployment means.

In applications requiring only a one time deployment, the means of deployment could simply be one or more longerons 54 under tension when the antenna is in its stowed position. When the casing is released, the longerons would urge the mechanism to its extended position. The positioning of the longerons during assembly of an antenna to be deployed only once is illustrated in FIG. 9. The once-deployable antenna with longer on deployment means is shown in its stowed position in FIG. 10.

The above disclosure is not intended as limiting. Those skilled in the art will readily observe that numerous modifications and alterations of the device may be made while retaining the teachings of the invention. Accordingly, the above disclosure should be construed as limited only by the metes and bounds of the appended claims.

I claim:

1. A deployable antenna comprising:

a retractable/extendable boom, a receiver/transmitter affixed to said boom, a reflector dish attached to a casing that contains said antenna, and a network of guy wires disposed in opposing pairs and attached to an inner side of panels which form a top side of said casing to said boom; wherein when said antenna is deployed, said panels are opened to pull said reflector dish to an open, deployed position, while said guy wires simultaneously pull said boom to an upright, deployed position, the guy wires thereafter supporting said boom in the upright, deployed position.

2. The deployable antenna of claim 1 wherein:

said boom includes at least one hinge and is located in a central area of said reflector dish.

3. The deployable antenna of claim 2 wherein:

said top side of said casing has a flat configuration.

4. The deployable antenna of claim 2 wherein:

said top side of said casing has a conical configuration.

5. The deployable antenna of claim 1 wherein:

said reflector dish is made from a flexible mesh material.

6. The deployable antenna of claim 5 wherein:

said top side of said casing has a flat configuration.

7. The deployable antenna of claim 5 wherein:

said top side of said casing has a conical configuration.

8. The deployable antenna of claim 1 wherein:

said top side of said casing has a flat configuration.

9. The deployable antenna of claim 1 wherein:

said top side of said casing has a conical configuration.

* * * * *